United States Patent [19]

Briner et al.

[11] 4,389,752

[45] Jun. 28, 1983

[54] METHOD OF PRODUCING A STAPLE FIBRE SLIVER AND APPARATUS FOR IMPLEMENTING THE METHOD

[75] Inventors: Emil Briner; Heinz Clement, both of Winterthur; Heiner Eberli, Steckborn, all of Switzerland

[73] Assignee: Rieter Machine Works Limited, Winterthur, Switzerland

[21] Appl. No.: 243,917

[22] PCT Filed: Jul. 5, 1980

[86] PCT No.: PCT/EP80/00045

§ 371 Date: Mar. 10, 1981

§ 102(e) Date: Feb. 27, 1981

[87] PCT Pub. No.: WO81/00263

PCT Pub. Date: Feb. 5, 1981

[30] Foreign Application Priority Data

Jul. 10, 1979 [CH] Switzerland ..... 6409/79

[51] Int. Cl.[3] ..... D01G 1/04; D01G 1/06; D01H 5/72

[52] U.S. Cl. ..... 19/0.56; 19/0.6; 19/150; 19/288

[58] Field of Search ..... 19/0.3, 0.35, 0.37, 19/0.39, 0.41, 0.43, 0.56, 0.6, 0.62, 66 T, 150, 288; 83/913

[56] References Cited

U.S. PATENT DOCUMENTS

| | | | |
|---|---|---|---|
| 2,111,139 | 3/1938 | Carliss | 19/157 X |
| 2,187,830 | 1/1940 | Jones | 19/157 X |
| 2,206,232 | 7/1940 | Martin | 19/288 |
| 2,248,806 | 7/1941 | Campbell | 19/0.51 |
| 2,260,383 | 10/1941 | Killars | 19/0.51 |
| 2,795,010 | 6/1957 | Hess | 19/0.56 |
| 2,908,043 | 10/1959 | Whitney | 19/0.51 X |
| 2,953,823 | 9/1960 | Lynch | 19/157 |
| 3,083,414 | 4/1963 | Gasser | 19/150 |
| 3,209,410 | 10/1965 | New et al. | 19/0.51 |
| 3,323,176 | 6/1967 | Naegeli | 19/66 T |

FOREIGN PATENT DOCUMENTS

| | | |
|---|---|---|
| 554418 | 7/1957 | Belgium . |
| 2112389 | 6/1972 | France . |
| 300885 | 8/1954 | Switzerland . |

*Primary Examiner*—Louis Rimrodt
*Attorney, Agent, or Firm*—Werner W. Kleeman

[57] ABSTRACT

The present invention concerns a method and an apparatus for producing a draftable staple fibre sliver (12) from a strand (12) of endless filaments, which is united and condensed for further processing. According to the invention the zone of the united and condensed sliver, from which, due to the cutting process, fibre points stick away inclined and pointed towards the front and outside, is inserted into the inside of the sliver.

In this manner the detrimental effects, caused by the fibre points sticking out, are eliminated. Particularly the defective points in the end product produced, caused by these fibre points, are eliminated, fly waste generation in the processing room is reduced and, owing to the reduction of the danger of clogging of the fibre sliver guiding funnels, the operational reliability of the subsequent processing machines is improved.

8 Claims, 3 Drawing Figures

METHOD OF PRODUCING A STAPLE FIBRE SLIVER AND APPARATUS FOR IMPLEMENTING THE METHOD

BACKGROUND OF THE INVENTION

The present invention concerns a method for producing a draftable staple fibre sliver, in which a strand of endless, parallel filaments of oblong cross-section continually is transported in its longitudinal direction, at intervals is cut under an acute angle relative to its longitudinal direction and in this process is separated into parallelogram-shaped sections, and that this strand separated into sections during this manner is united at both its sides and is condensed and transformed into a staple fibre sliver of approximately circular cross-section.

From Swiss Pat. No. 300 885 there is known the transformation of a fibre layer consisting of endless filaments into a transportable and draftable staple fibre sliver. In this process the flat fibre layer always is advanced in its longitudinal direction and periodically is cut. Subsequently it is united from both sides and is condensed. By cutting the fibre layer in a direction under an angle to the longitudinal direction parallelogram-shaped sections of the fibre layer are formed.

It has been found by experience that at the forwardmost points, as seen in the direction of sliver movement, of the individual sliver sections, the cut fibre ends pointed or directed towards the front stick out laterally and form fibre points or tips. These disturb the further processing of the fibre sliver and cause defective points or regions in the sliver, or the roving respectively, produced in the further processing steps, such that the quality of the end products produced therefrom is impaired. Further they cause increase of fly waste in the processing room. Also they increase the danger of clogging at the sliver funnels, and thus, deteriorate the reliability of the subsequent machines.

SUMMARY OF THE INVENTION

It thus is and important object of the present invention to eliminate these disadvantages. This invention is characterized in that the zone of the staple fibre sliver along a sleeve line or generatrix, along which in uniting and condensing of the strand the forwardmost points, as seen in the direction of the sliver movement, of the parallelogram-shaped sections are aligned, is inserted continually into the inside of the sliver, a staple fibre sliver of approximately kidney-shaped cross-section being formed.

The present invention furthermore concerns an apparatus for implementing the above mentioned method, with a uniting and condensing point or location for a lateral uniting and condensing of the strand. This apparatus is characterized in that in the path of the staple fibre sliver of approximately circular cross-section a rolling-in roll with a disc is provided, which in the zone of the sleeve line or generatrix protrudes into the inside of the staple fibre sliver.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
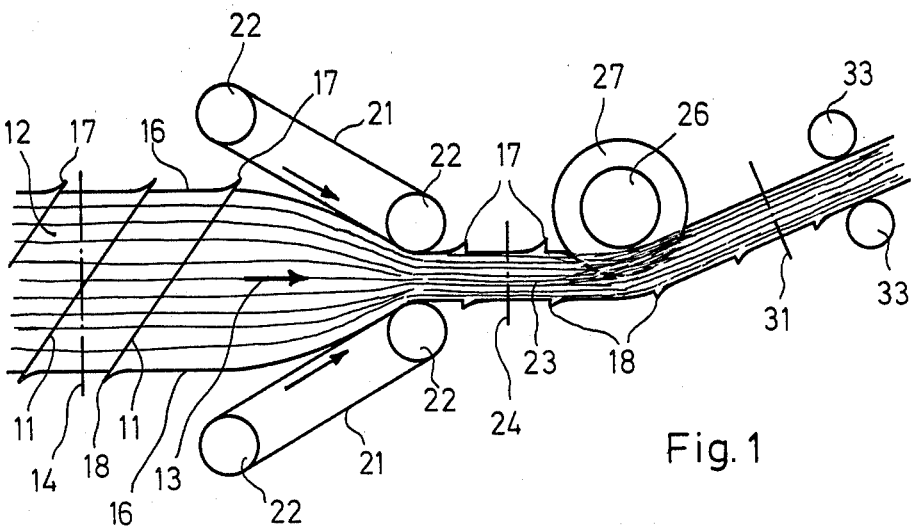
FIG. 1 is a schematic view serving for explaining the function.

In FIG. 1 cutting points or locations 11 are shown, at which a strand 12 consisting originally of endless, parallel filaments, and which is transported continually in the direction of arrow 13, is cut. Cutting can be effected, e.g. by knives extending helically on a roll, which are not shown in the drawing, as they do not concern the present invention. The strand 12 is of oblong or elongate cross-section, as indicated by the cross-section 15 at the point or location 14. It should be recognized that by the cutting operation parallelogram-shaped sections are produced, limited by the cutting points 11 and the lateral edges 16 of the strand 12. It is unavoidable that cutting causes the fibre ends at the cutting points or locations 11 to form points or tips 17 laterally sticking out from one edge 16 and pointed forward, and that the fibre ends sticking out of the other edge 16 form points or tips pointing backward.

After the cutting process the strand 12 is transported between the endless belts 21, which continually rotate on rolls 22 in the direction indicated by the arrows. In this arrangement the belts 21 move towards the lateral edges 16, press them together and condense the strand 12 into a staple fibre sliver 23. In this process a sliver 23 of approximately circular cross-section is produced, as indicated by the cross-section 25 present at the point or location 24.

Figure 2:
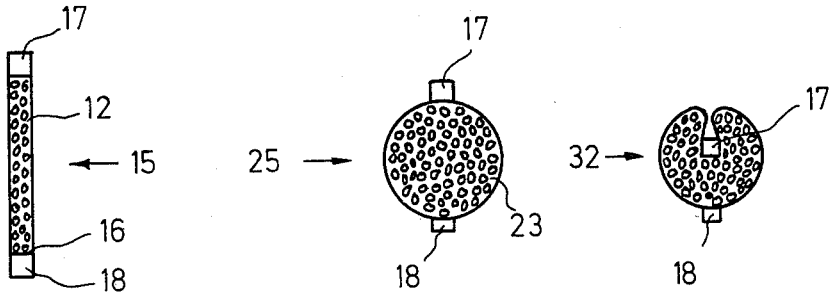
FIG. 2 is an exemplary embodiment of the rolling in-roll.
Figure 2:
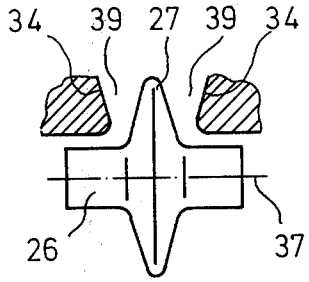

Subsequently the staple fibre sliver 23 passes over a rolling-in roll 26. As shown in FIG. 2, this roll is provided with a disc 27, which in the zone of an imagined sleeve line or imaginary generatrix of the sliver 23, extending parallel to the latter at the location of the points 17, protrudes into the strand 23. In this manner this zone is inserted into the center of the sliver 23 in such a manner that the structure of the sliver 23 is changed such, as shown by the cross-section 32 present at the point or location 31. This is of kidney-shaped form, the points or tips 17 now being imbedded in the center of the sliver 23. The transporting rolls 33 further move the sliver 23 along its path of travel.

It has been found by experience, that the points or tips 18 pointing backward in relation to the direction of arrow 13, practically are of no detrimental consequence. The points 17 pointed forward, however, cause the difficulties already mentioned in further processing of the staple fibre sliver 23. They are maintained during the uniting and condensing processes during the passage between the belts 21.

According to the embodiment shown in FIG. 1 these disadvantages are to be eliminated in that the zone or region of the fibre sliver 23 along the imaginary sleeve line or generatrix thereof, which extends through the forwardmost points or tips 17, as seen in the direction of arrow 13, of the parallelogram-shaped sections 11, is brought into the center of the sliver 23. In this process, after passing over the rolling-in roll 26, the sliver 23 takes on the structure already mentioned and shown in the cross-section 32. With the zone extending along the aforementioned sleeve line or generatrix, also the forward pointing tips or points 17 have become imbedded into the center of the sliver 23. There they are rendered harmless during further processing, i.e. they are imbedded among the other fibres. The disc 27, at the zone of its maximum circumference, is rounded off and increases in thickness towards its rotational axis 37.

For maintaining the cross-sectional shape of the fibre sliver 23 as circular as possible under the influence of the rolling-in roll, at both sides of the disc 27 there can be provided a respective guide wall 34 which can be set, as has been indicated in FIG. 2. For better clarity, this guide wall 34 is not shown in FIG. 1. The guide walls 34 together with the disc 27 form a respective trough-shaped recess 39.

Figure 3:
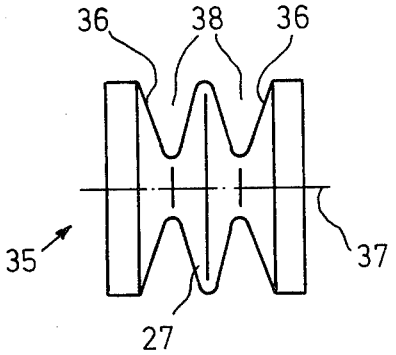
FIG. 3 illustrates a further embodiment of this roll.

Another shape of the guide walls is shown in FIG. 3. According to FIG. 3 the rolling-in roll 35 comprises a respective roll or roll member 36 provided at the sides of the rolling-in disc 27, the purpose of which is to maintain the sliver 23 cross-section circular and compact. The immediately neighbouring side walls of the rolling-in disc 27 and each related respective roll member 36 converge in the direction towards the rotational axis 37 and merge, in such manner that, at both sides of the disc 27 a trough 38 surrounding the rolling-in roll 35 is present.

It is advisable to adapt the surface speed of the disc 27 to that of the strand 23 in such manner that on the average they are equal, so that thus the staple fibre sliver 23 slides on the disc 27 as little as possible. In this manner the number of fibres loosened from the strand 23 and clinging to the rolling-in roll 26 or 35, respectively, are at a minimum.

Furthermore, it is advantageous if the sliver 23 passes under a slight deflection or kink over the rolling-in roll 26 or 35, respectively. In FIG. 1 the deflection is shown. It is effected in that the travel direction of the sliver moving away from the rolling-in roll 26 slightly differs from its direction moving towards the roll 26. The angle formed by both parts of the staple fibre sliver 23 is smaller than 180° and advantageously ranges between 150° and 170°.

While there are shown and described present preferred embodiments of the invention, it is to be distinctly understood that the invention is not limited thereto, but may be otherwise variously embodied and practiced within the scope of the following claims.

Accordingly, we claim:

1. A method of producing a draftable staple fibre sliver, comprising the steps of:

continuously transporting a strand composed of endless, substantially parallel filaments and possessing a substantially elongate cross-sectional configuration in the longitudinal direction of said strand;

cutting the transported strand at intervals at an acute angle relative to its longitudinal direction of movement, to thereby separate the strand into substantially parallelogram-shaped sections;

uniting and condensing at both sides thereof the strand thus separated into sections and transforming the strand into a staple fibre sliver of approximately circular cross-sectional configuration; and continually inserting the region of the staple fibre sliver along a generatrix thereof, along which come to lie forwardmost points of the parallelogram-shaped sections during the uniting and condensing of the strand, into the interior of the staple fibre sliver in such a manner that there is formed a staple fibre sliver possessing an approximately kidney-shaped cross-sectional configuration.

2. The method as defined in claim 1, further including the steps of:

inserting said region of the staple fibre sliver along said generatrix into the interior of the staple fibre sliver up to a central region of said staple fibre sliver.

3. An apparatus for producing a draftable staple fibre sliver from a strand composed of endless, substantially parallel filaments and possessing a substantially elongate cross-sectional configuration and moved in a predetermined path of travel extending in the longitudinal direction of the strand, comprising:

means for laterally uniting and condensing the moving strand into a staple fibre sliver possessing a substantially circular cross-sectional configuration;

a rotatable rolling-in roll having an axis of rotation and containing a disc arranged along the path of travel of the staple fibre sliver possessing said approximately circular cross-sectional configuration; and said rolling-in roll protruding into a predetermined region of a generatrix of said sliver containing forwardly protruding points for displacing said region together with said forwardly protruding points of said staple fibre sliver into the interior of the staple fibre sliver.

4. The apparatus as defined in claim 3, wherein:

said disc of said rolling-in roll is provided with a rounded-off portion at a zone of a maximum circumference thereof and increases in size from said zone towards said axis of rotation of said rolling-in roll.

5. The apparatus as defined in claim 3, further including:

means for transporting the sliver;

said means for uniting and condensing the strand, said rolling-in roll and said transport means for transporting the sliver being successively arranged along said path of travel of said staple fibre sliver; and said staple fibre sliver having respective sliver portions extending from the rolling-in roll in opposite directions towards said uniting and condensing means and said transport means, respectively, and said sliver portions enclosing an angle therebetween which is less than 180°.

6. The apparatus as defined in claim 5, wherein:

said angle is in a range of about 150° to 170°.

7. The apparatus as defined in claim 3, further including:

guide means provided to each side of said disc of said rolling-in roll and arranged in spaced relationship from said disc;

said disc having side walls; and said guide means together with said side walls of said disc forming a respective substantially trough-shaped recess.

8. The apparatus as defined in claim 7, wherein:

said disc of said rolling-in roll is provided with a rounded-off portion at a zone of a maximum circumference thereof and increases in size from said zone towards said axis of rotation of said rolling-in roll;

a respective roll member provided to each side of said disc of said rolling-in roll;

said roll members defining said guide means;

said roll members and said disc having neighbouring walls which converge in the direction of the axis of rotation of said rolling-in roll and form a respective trough which continuously surrounds said rolling-in roll; and said walls of said disc defining said side walls.

* * * * *